US009480293B2

(12) United States Patent
Pfanner et al.

(10) Patent No.: US 9,480,293 B2
(45) Date of Patent: Nov. 1, 2016

(54) TENSIONING UNIT FOR A SUPPORTING BAND OF A PROTECTIVE HELMET, IN PARTICULAR FOR FORESTRY WORKERS

(75) Inventors: Anton Pfanner, Hohenems (AT); Martin Greber, Götzis (AT)

(73) Assignee: PFANNER SCHUTZBEKLEIDUNG GMBH, Hohenems (AT)

( * ) Notice: Subject to any disclaimer, the term of this patent is extended or adjusted under 35 U.S.C. 154(b) by 755 days.

(21) Appl. No.: 13/808,787

(22) PCT Filed: Jul. 12, 2011

(86) PCT No.: PCT/EP2011/061881

§ 371 (c)(1),
(2), (4) Date: Feb. 25, 2013

(87) PCT Pub. No.: WO2012/007474

PCT Pub. Date: Jan. 19, 2012

(65) Prior Publication Data

US 2013/0205478 A1 Aug. 15, 2013

(30) Foreign Application Priority Data

Jul. 13, 2010 (DE) ..... 10 2010 026 998

(51) Int. Cl.
*A42B 3/08* (2006.01)
*A42B 3/14* (2006.01)

(52) U.S. Cl.
CPC ..... *A42B 3/08* (2013.01); *A42B 3/085* (2013.01); *A42B 3/142* (2013.01)

(58) Field of Classification Search
CPC ..... A42B 3/08; A42B 3/085; A42B 3/142; A42B 3/145
See application file for complete search history.

(56) References Cited

U.S. PATENT DOCUMENTS 2,205,741 A * 6/1940 Bowers ..... A42B 3/145 157/1.21
2,205,742 A * 6/1940 Bowers ..... A42B 3/145 2/418
2,511,234 A * 6/1950 Anderson ..... A42B 3/145 2/8.1
2,769,176 A * 11/1956 Grancsay ..... A42B 3/085 2/421

(Continued)

FOREIGN PATENT DOCUMENTS

DE 4444188 A1 6/1996
DE 20114637 U1 9/2002

(Continued)

OTHER PUBLICATIONS

International Search Report for International Application PCT/EP2011/061881, mailed on Nov. 17, 2011.

*Primary Examiner* — Richale Quinn
(74) *Attorney, Agent, or Firm* — Fitch, Even, Tabin & Flannery, LLP

(57) ABSTRACT

A tightening unit is described for a supporting band which is attached to the lower edge of interior fittings of a protective helmet for fastening the helmet on the head of a user. The supporting band comprises a head band which continues in a neck band which has two free ends connected to each other by a basic body of the tightening unit. The tightening unit has a neck shell and a basic body which are connected to each other in an articulated manner by a transmission lever. The basic body can be pivoted relative to the neck shell by a tightening lever linked thereto which is supported on the transmission lever by a cam.

10 Claims, 7 Drawing Sheets

(56) References Cited

Figure 1:
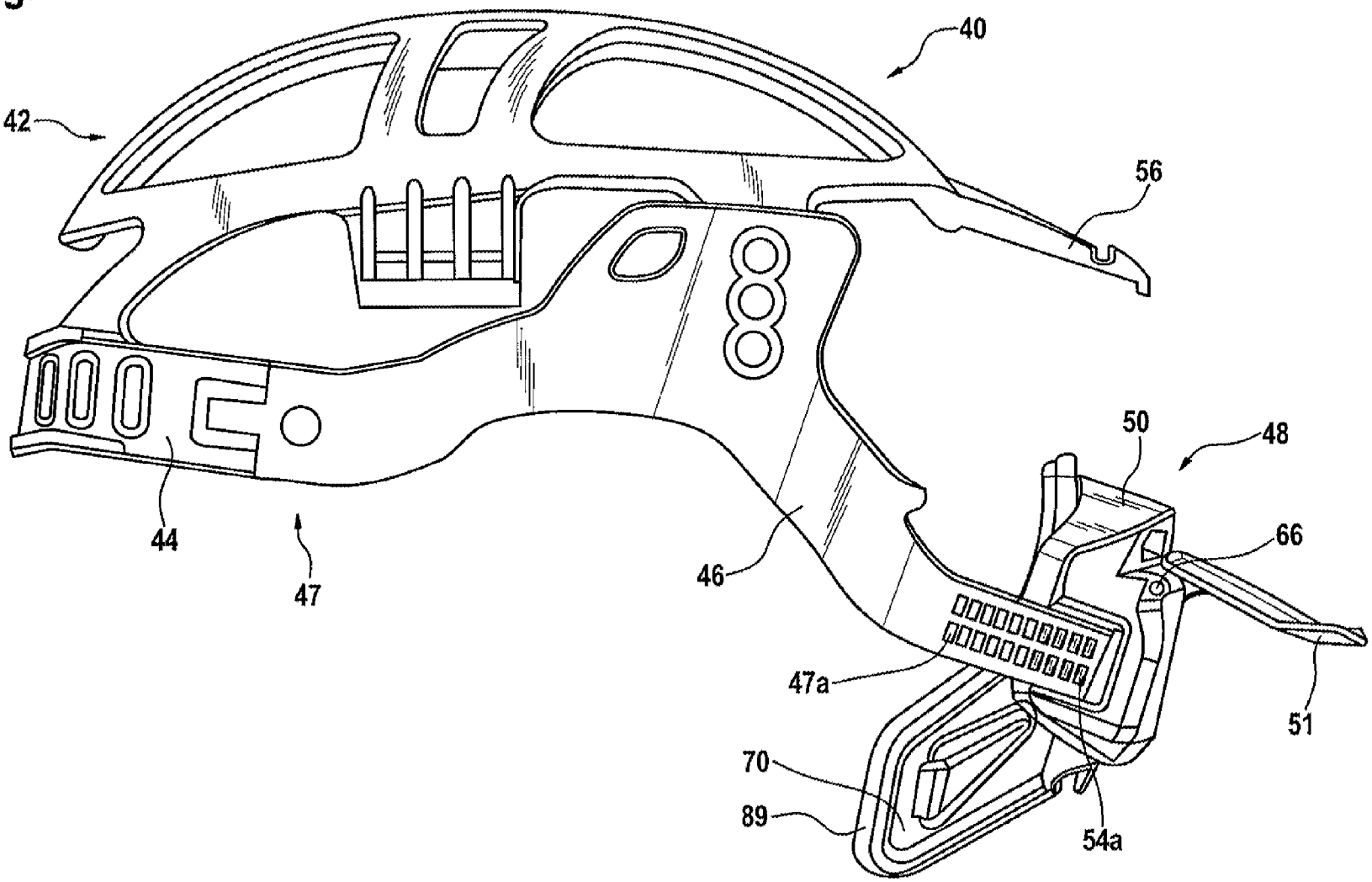

U.S. PATENT DOCUMENTS 2,814,043 A * 11/1957 Alesi ..... A42B 3/085 2/421
2,926,406 A * 3/1960 Edwards ..... A42B 3/145 2/418
3,591,863 A * 7/1971 Rickard ..... A42B 3/085 2/415
3,696,442 A * 10/1972 Amundsen ..... A61F 9/06 2/8.1
3,852,821 A * 12/1974 Mickel ..... A42B 3/142 2/415
5,042,093 A * 8/1991 Legendre ..... A42B 3/145 2/419
5,160,159 A * 11/1992 Gorza ..... A63C 9/0846 280/632
5,357,654 A * 10/1994 Hsing-Chi ..... A42B 3/145 2/418
5,572,749 A * 11/1996 Ogden ..... A42B 3/14 2/410
5,794,272 A * 8/1998 Workman ..... A42B 3/085 2/421
5,950,245 A * 9/1999 Binduga ..... A42B 3/145 2/183
5,983,405 A * 11/1999 Casale ..... A42B 3/145 2/417
6,219,851 B1 * 4/2001 Fang ..... A42B 3/145 2/418
6,226,802 B1 * 5/2001 Sasaki ..... A42B 3/085 2/417
6,314,588 B1 * 11/2001 Fang ..... A42B 3/145 2/183
6,968,575 B2 * 11/2005 Durocher ..... A42B 3/324 2/418
7,174,575 B1 * 2/2007 Scherer ..... A42B 3/145 2/418
7,222,374 B2 * 5/2007 Musal ..... A42B 3/08 2/417
7,954,178 B2 * 6/2011 Durocher ..... A42B 3/324 2/418
8,032,993 B2 * 10/2011 Musal ..... A42B 3/145 2/418
8,037,548 B2 * 10/2011 Alexander ..... A42B 3/127 2/417
8,056,150 B2 * 11/2011 Stokes ..... A42B 3/145 2/417
8,161,576 B2 * 4/2012 Lemke ..... A42B 3/145 2/417
8,359,672 B2 * 1/2013 Moelker ..... A42B 1/22 2/181
8,370,967 B2 * 2/2013 Chen ..... A42B 3/145 2/414
8,505,121 B2 * 8/2013 Ahlgren ..... A42B 3/085 2/417
8,510,870 B2 * 8/2013 Rogers ..... A42B 3/324 2/417
8,850,624 B2 * 10/2014 Gleason ..... A42B 3/142 2/181
8,875,318 B2 * 11/2014 Huh ..... A42B 3/145 2/416
8,959,723 B2 * 2/2015 Gennrich ..... A42B 3/145 2/410
9,066,552 B2 * 6/2015 Ahlgren ..... A42B 3/085
2004/0117897 A1 * 6/2004 Udelhofen ..... A42B 3/324 2/421
2005/0262618 A1 * 12/2005 Musal ..... A42B 3/145 2/417
2006/0156448 A1 * 7/2006 Garneau ..... A42B 3/145 2/10
2007/0250986 A1 * 11/2007 Zuber ..... A42B 3/145 2/171
2008/0295229 A1 * 12/2008 Fang ..... A42B 3/145 2/418
2009/0044315 A1 * 2/2009 Belanger ..... A42B 3/324 2/414
2009/0222978 A1 * 9/2009 Fang ..... A42B 3/085 2/421
2009/0293180 A1 * 12/2009 Grau ..... A42B 3/147 2/417
2009/0320186 A1 * 12/2009 Petzl ..... A42B 3/145 2/417
2010/0050323 A1 * 3/2010 Durocher ..... A42B 3/324 2/414
2010/0095438 A1 * 4/2010 Moelker ..... A42B 1/22 2/418
2010/0281604 A1 * 11/2010 Grim ..... A42B 3/145 2/417
2011/0047679 A1 * 3/2011 Rogers ..... A42B 3/324 2/414
2011/0191946 A1 * 8/2011 Fang ..... A42B 3/145 2/418
2011/0289659 A1 * 12/2011 Lanez ..... A42B 3/145 2/411
2012/0144565 A1 * 6/2012 Huh ..... A42B 3/145 2/421
2015/0059065 A1 * 3/2015 Klotz ..... A42B 3/145 2/418
2015/0074876 A1 * 3/2015 Chiang ..... A42B 3/145 2/418
2015/0250251 A1 * 9/2015 Ahlgren ..... A42B 3/142 2/8.2

FOREIGN PATENT DOCUMENTS

DE 102010026998 A1 1/2012
JP H0724936 U 5/1995
JP 2003-221724 A 8/2003
WO 98/56270 A1 12/1998
WO 2005/027671 A1 3/2005
WO 2007/013106 A1 2/2007

* cited by examiner

TENSIONING UNIT FOR A SUPPORTING BAND OF A PROTECTIVE HELMET, IN PARTICULAR FOR FORESTRY WORKERS

CROSS-REFERENCE TO RELATED APPLICATIONS

This application is a U.S. National Stage filing under 35 U.S.C. 371 of International Application No. PCT/EP2011/061881, filed Jul. 12, 2011, designating the United States and claims the benefit of foreign priority from German Patent Application Number 10 2010 026 998.0, filed Jul. 13, 2010, the entire disclosures of which are incorporated herein by reference.

The invention relates to a tightening unit for a supporting band attached to the lower edge of interior fittings of a protective helmet for fastening the helmet on the head of a user comprising a head band continuing in a neck band having two free ends connected to each other by a basic body the tightening unit comprising an operating element for tightening the supporting band.

Such a tightening unit for such a protective helmet having such interior fittings is known from the document WO 2005/027671 A1. In this known protective helmet, the basic body is a curved hollow profile part having a rectangular cross section into the ends of which the free ends of the neck band are inserted. The operating element of the tightening unit is a rotary button. The type of coupling between the rotary button and the neck band cannot be derived from this document. It is only indicated that the tightening unit serves to adjust an inner diameter of the supporting band, the inner surface of the basic body being in close contact with the back of the head of the user of the helmet. By tightening the neck band by operating the operating button, the relatively sharp-edged basic body is pushed against the back of the head of the user of the helmet. This could be rather uncomfortable. The adjustment of the supporting band to the size of the head of the user of the helmet is effected at the back of the head when the helmet is on and is therefore inconvenient. When used in forestry or heavy industry where gloves are worn, an adjustment of the helmet might forestry or heavy industry where gloves are worn, an adjustment of the helmet might only be possible after having removed the gloves. For taking off the helmet, the operating element has to be released again which might also be impossible with gloves. Users of the helmet might therefore tend to adjust the supporting band so that the helmet can be put on and taken off without changing the size once adjusted. It is clear that such a helmet would then not be sufficiently tightly fitting.

From the document DE 201 14 637 U1, a strap system including an automatic size adjustment for helmets, particularly for sports and bicycle helmets, is known. The strap system has to be adjusted to the respective head and neck sizes of the users of the helmet. To facilitate the adjustment of the strap system, this is formed so that it is flexible to the extent that the user can place the helmet including the strap system on the head. The strap system automatically adjusts itself to the head and neck contour and is then locked on the helmet by means of a clamping fastener. Here, a clamping lever serves to clamp a strap in a desired position. The clamping lever fixes the strap only in the position which the user of the helmet previously adjusted by pulling on the strap system of the helmet.

The document DE 44 44 188 A1 shows a bicycle helmet in which the chin and neck straps are tightened by a quick clamping device. The quick clamping device comprises a lever attached to the outside of the helmet shell on which a tightening strap is fastened. The tightening strap is tightened by moving the lever.

From the document WO 98/56270, finally, a bicycle helmet is known which has a tension fastening device comprising a tightening lever hinged to the inside of an outer helmet shell. The tension applied by the tightening lever tightens cords to thereby establish a contact to a neck support on the back of the head.

The helmets according to the three last mentioned documents are sports helmets, particularly bicycle helmets, the strap system of which is not comparable to the interior fittings of a protective helmet as used in forestry and industry.

It is the object of the invention to provide a tightening unit of the type mentioned in the beginning which is formed so that it does not impair the wearing comfort of the protective helmet provided with it and can be effortlessly operated on back of the head of the user of the helmet even with a gloved hand.

According to the invention, this object is solved by a tightening unit of the type mentioned in the beginning in that the tightening unit comprises a neck shell to which the basic body is hinged, and in that the operating element is a tightening lever linked to the basic body by means of which the basic body is pivotable relative to the neck shell. In the tightening unit according to the invention, only the basic body is pivoted away from the neck shell when the supporting band is tightened. The neck shell itself may unvariedly remain in its most comfortable position in which it contacts the back of the head.

Advantageous embodiments of the tightening unit according to the invention constitute the subject matter of the sub-claims.

In one embodiment of the tightening unit according to the invention, the basic body and the neck shell are connected by a transmission lever linked to the neck shell on a first end and to the basic body on a second end. The neck shell is freely pivotable relative to the basic body and can therefore be adjusted to any head shape so that the tightening unit does not impair the wearing comfort of the protective helmet.

In a further embodiment of the tightening unit according to the invention, the transmission lever is linked to the basic body at a position located on the basic body above the linking point of the tightening lever. The basic body and the neck shell are therefore pivotable relative to each other to the greatest possible extent.

In a further embodiment the tightening unit according to the invention, the tightening lever is provided with a cam supported on the transmission lever in the area of its linking point on the basic body. When the tightening lever is operated, therefore, the neck shell remains unaffected by the tightening process so that no impairment of the wearing comfort takes place.

In a further embodiment of the tightening unit according to the invention, the transmission lever is, on its second end, provided with a pre-stressing spring which urges the first end of the transmission lever against an end of the basic body opposed to the linking point of the tightening lever. In this way, the basic body is retained in a position on the transmission lever in which the maximum tightening path for the neck band is available.

In a further embodiment of the tightening unit according to the invention, a spring element striving to pivot the neck shell in the direction away from the second end of the transmission lever is disposed adjacent to the first end of the transmission lever. In this way, it is still ensured that the basic body leaves the position of the neck shell unaffected during the tightening process, i.e., during the operation of the tightening lever.

In a further embodiment of the tightening unit according to the invention, the spring element is a resilient finger integrally formed on the neck shell. The tightening unit can, in this case, be integrally and inexpensively produced together with the resilient finger in one moulding process.

In a further embodiment of the tightening unit according to the invention, the neck shell comprises, at the linking point of the transmission lever, a fork having resilient arms engaging in complementary bores in the first end of the transmission lever with integrally formed tappets.

The neck shell can be manufactured as a separate part which can be simply connected to the transmission lever by being clipped in.

In a further embodiment of the tightening unit according to the invention, the basic body comprises two surfaces having protrusions which can be brought in a positive engagement with complementary holes in the free ends of the neck band on both sides of the tightening lever. This renders it possible to crudely adjust the supporting band to the size of the head when the helmet is not yet put on. When the helmet is put on, the helmet can then finally be fastened on the head for good with the aid of the supporting band by operating the tightening lever.

In a further embodiment of the tightening unit according to the invention, the basic body is respectively provided with an orifice for accommodating the free ends of the neck band on both sides between the protrusions and the tightening lever. This renders it possible that the free ends of the neck band protruding beyond the position in which the protrusions of the basic body are engagemed with the complementary holes of the neck band are accommodated in the basic body and therefore cannot be an encumbrance to the user of the helmet while operating and releasing the tightening unit.

Figure 2:
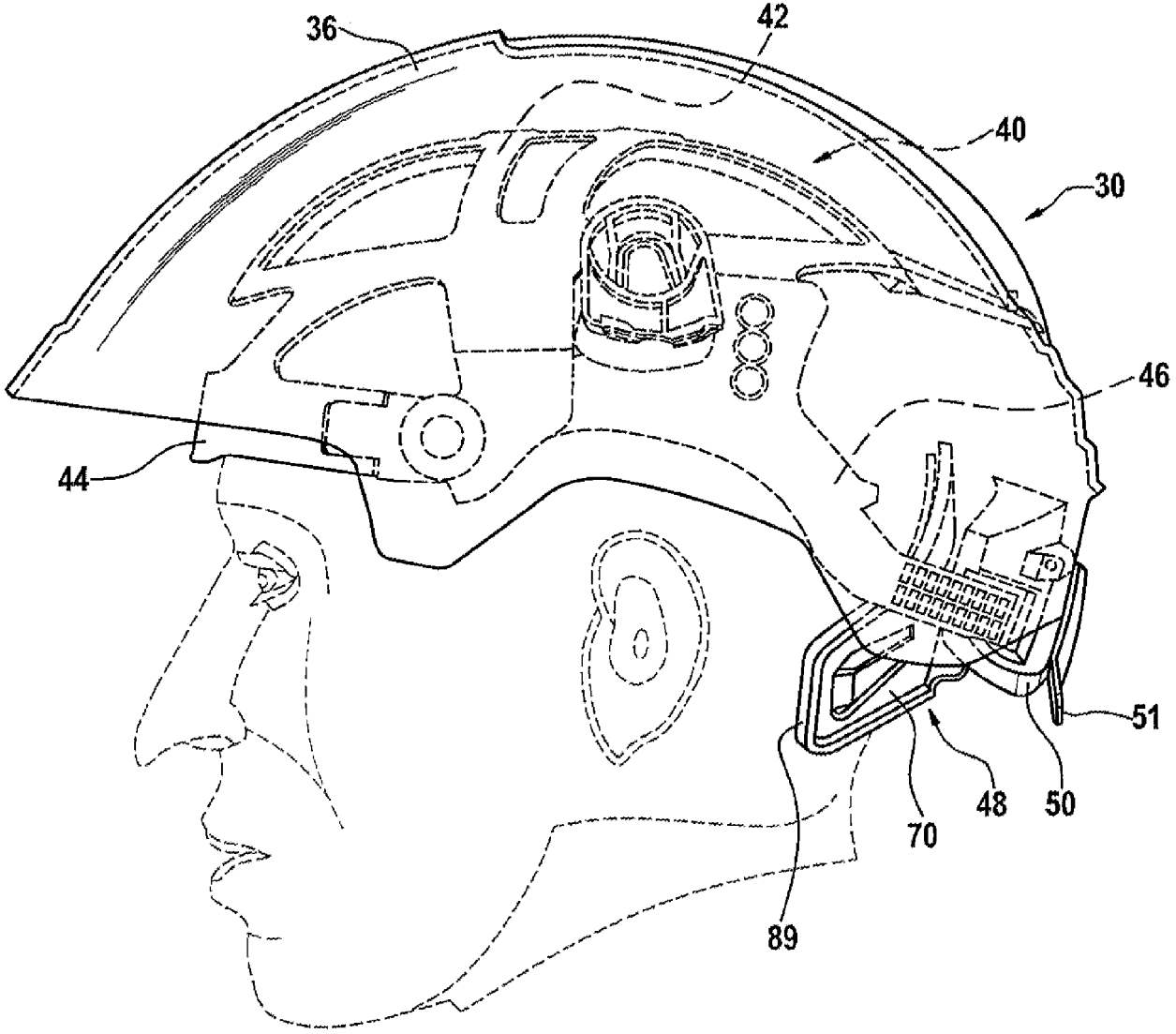
Figure 3:
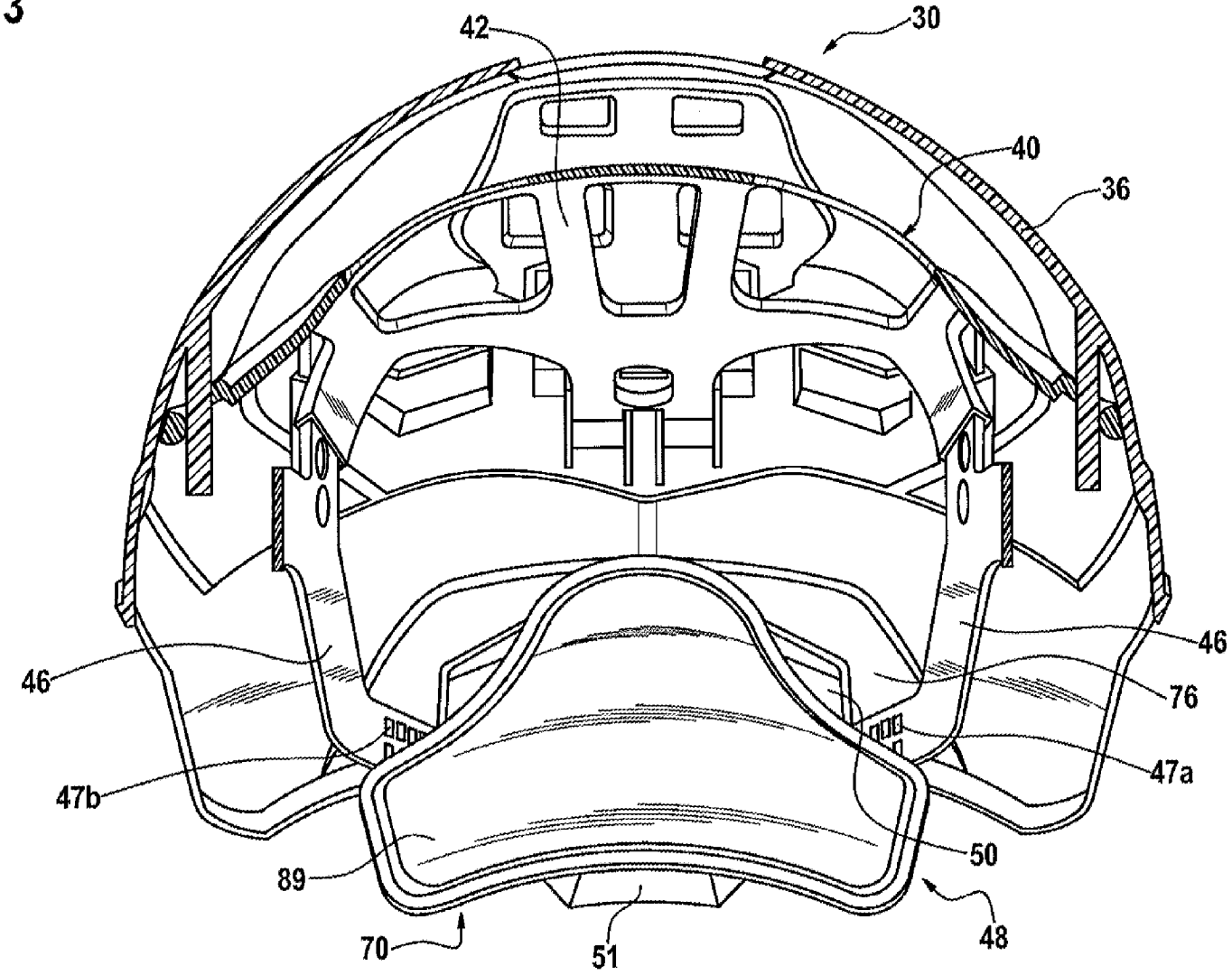
Figure 4:
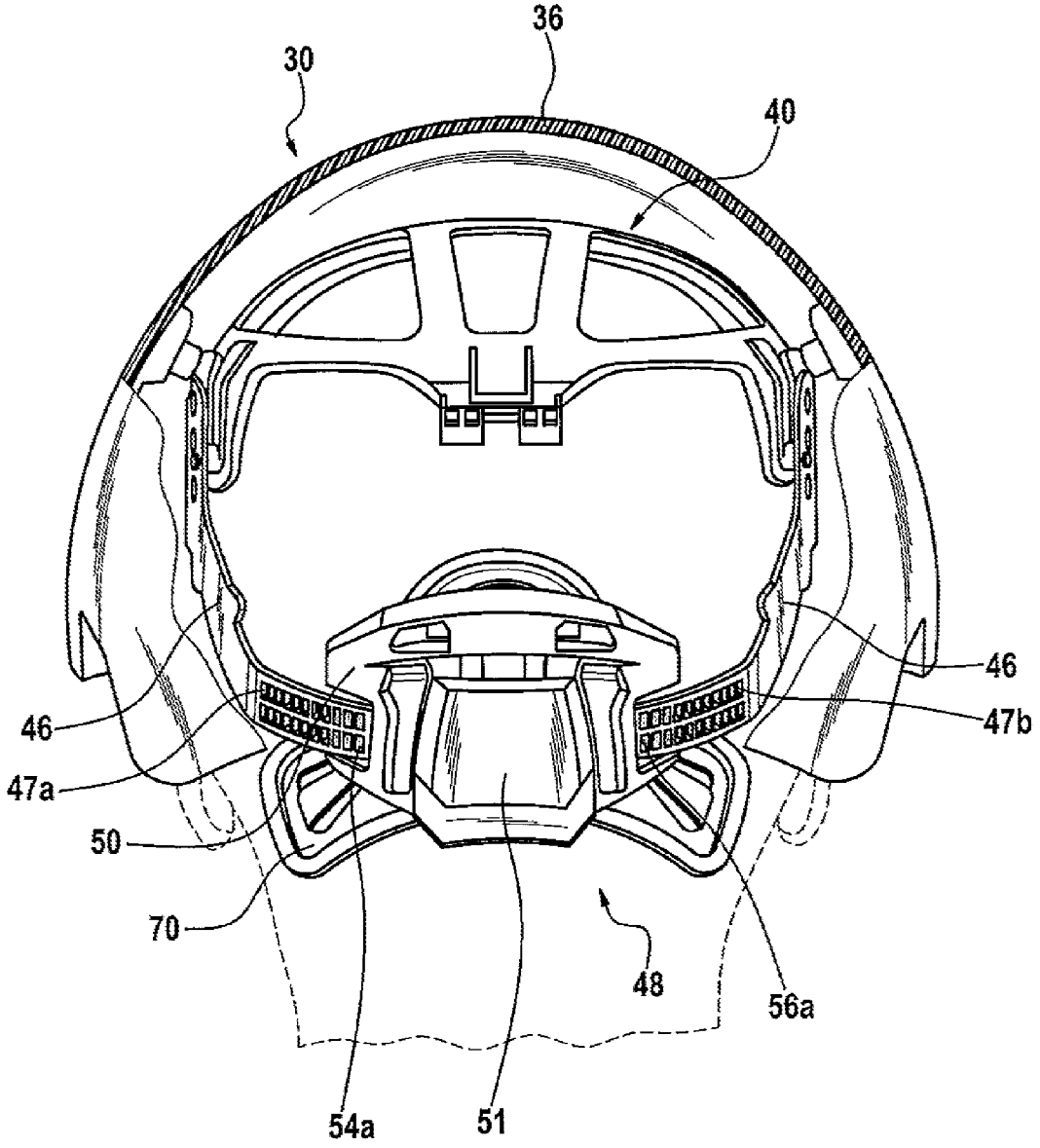
Figure 5B:
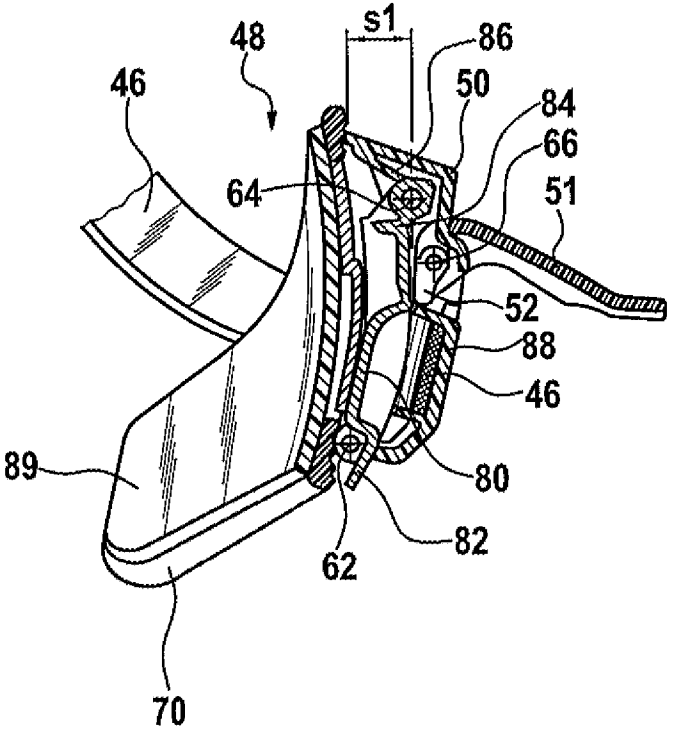
Figure 5A:
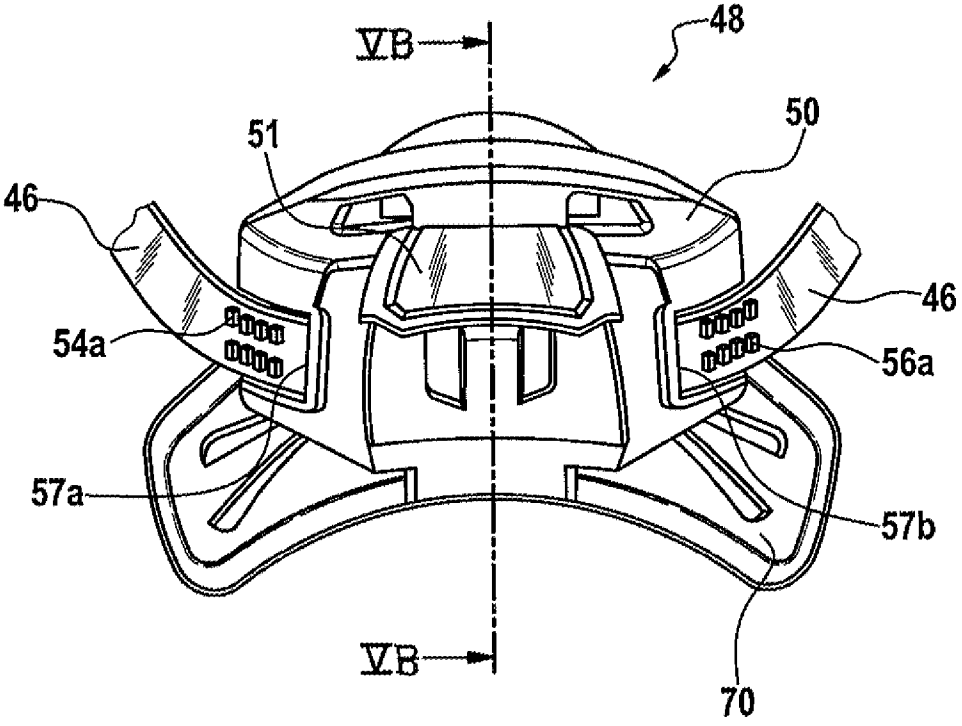
Figure 6B:
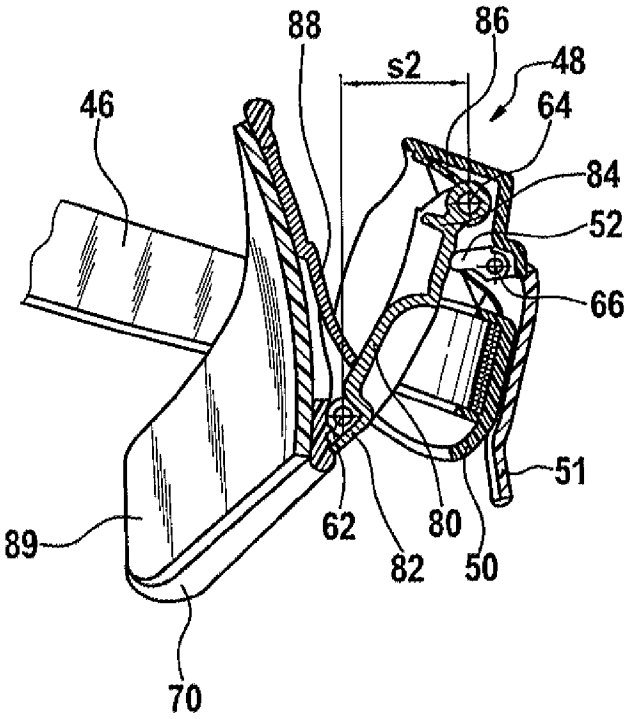
Figure 6A:
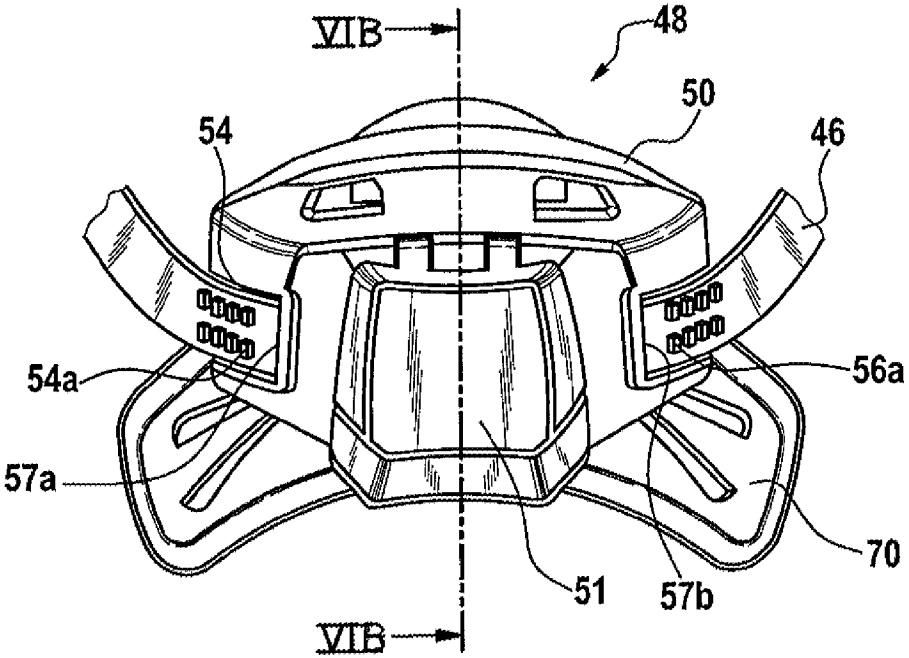
Figure 7:
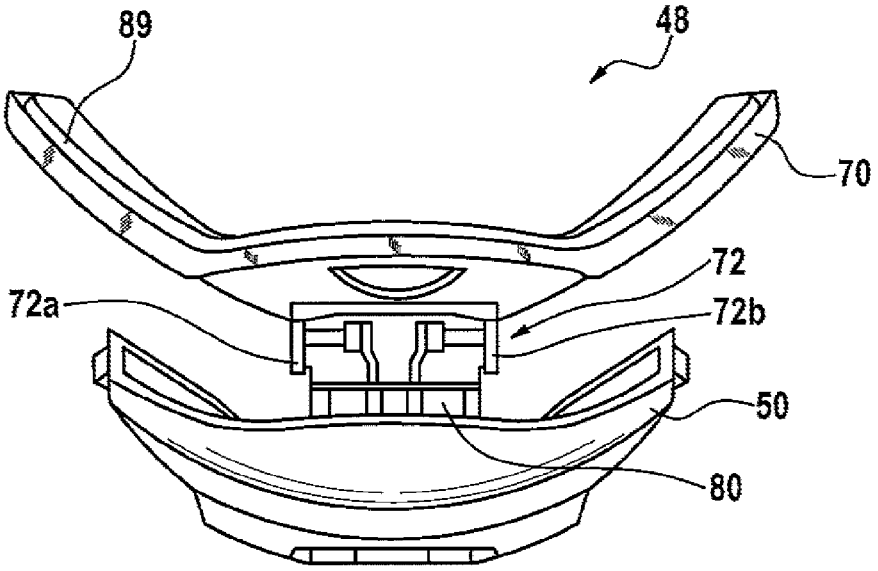
Figure 8:
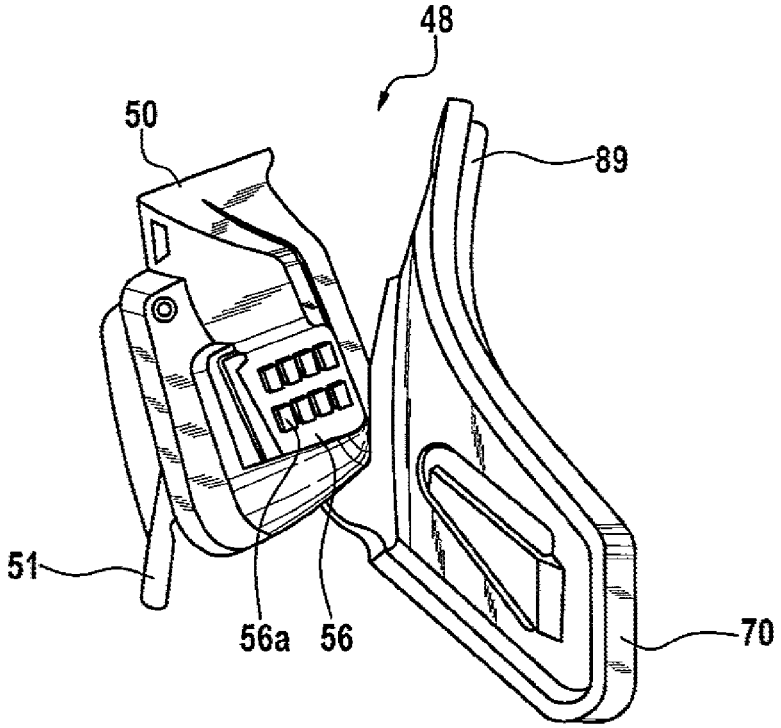

Embodiments of the invention will be described below with reference to the drawings in which:

FIG. 1 shows an interior fitting subassembly of a protective helmet (not shown) provided with a tightening unit according to the invention in which the two ends of a neck band are releasably connected by the tightening unit in the neck area, FIG. 2 shows a side view of a protective helmet in which the interior fitting subassembly according to FIG. 1 is mounted in the helmet shell together with the tightening unit according to the invention, FIG. 3 shows a sectional view of the protective helmet according to FIG. 2 as viewed in the rearward direction, FIG. 4 shows a partly broken representation of the protective helmet according to FIG. 2 as viewed in the forward direction, FIG. 5A shows, as a detail, a rear view of the tightening unit according to the invention, a tightening lever being shown in non-operated position, FIG. 5B shows a sectional view of the tightening unit along the line VB-VB in FIG. 5A, FIG. 6A shows the tightening unit according to FIG. 5A, the tightening lever, however, being shown in the operated position, FIG. 6B shows a sectional view of the tightening unit along the line VIB-VIB in FIG. 6A, FIG. 7 shows a plan view of the tightening unit according to FIGS. 6A and 6B, and FIG. 8 shows a side view of the tightening unit according to FIG. 7.

According to the illustration in FIGS. 1-4, an interior fitting subassembly designated by 40 as a whole comprises a support cage 42 and a supporting band 47 comprised of a head band 44, a supporting band 47, and a neck band 46. The supporting band 47 is provided with a tightening unit designated by 48 as a whole in the area of the neck band 46.

According to the illustration in FIGS. 2 and 3, a helmet shell 36 of a protective helmet 30 is, at the lower edge on the rear side in the centre, provided with a recess 76 behind which the tightening unit 48 of the supporting band 47 is located which, in this way, is accessible for a manual operation, even with a glove, for tightening or releasing the supporting band 47.

The interior fitting subassembly 40 is generally the part of a protective helmet which contacts the head. The interior fitting subassembly 40 can be fixed on the helmet shell 36 to support and fasten the helmet 30 on the head of a user. The support cage 42 is, in the present case, produced as an integral plastics moulding. The head band 44 is integrally formed on the support cage 42. The neck band 46 has two front ends releasably connected to rear free ends of the head band 44, for example, by a snap-on connection not shown in detail in the Figures. The neck band 46 has two free ends connected to each other by the tightening unit 48 in the neck area. The neck band 46 may be formed of the same material as the support cage 42. The neck band 46 is respectively connected to the support cage 42 between its connections to the head band 44 and its free ends so as to be adjustable in height as can be seen, for example, in FIG. 1. For this purpose, the neck band 46 has three holes 51 disposed one above each other on each side which are lockable on a resilient bolt protruding from the support cage 42. In this way, the tightening unit 48 can be adjusted to different head shapes and brought in the most comfortable position with the neck shell 70 on the back of the head.

In the following, the tightening unit 48 will be described in more detail. The tightening unit 48 is, like an ear protection (not shown), part of the accessories of the helmet shown in FIG. 2 which always remain within the perimeter of the helmet shell 36 so that even in the area of the tightening unit 48 no protruding parts are present on the helmet 30 on which obstacles might get caught when the helmet is used. FIG. 2 shows a side view of the interior fitting subassembly 40 of the protective helmet 30 in which the two ends of the neck band 46 are releasably connected by the tightening unit 48 in the neck area. The tightening unit 48 is shown in the tightened state. FIG. 3 shows a sectional view of the protective helmet 30 as viewed in the rearward direction. FIG. 4 shows a partly broken illustration of the protective helmet 30 according to FIG. 3 as viewed in the forward direction.

The design and the principle of operation of the tightening unit 48 will be described in detail with reference to FIGS. 5 to 8. FIG. 5A shows the tightening unit 48 in a view from the rear side. FIG. 5B shows a sectional view of the tightening unit 48 along the line VB-VB in FIG. 5A. The tightening unit 48 comprises a neck shell 70 to which a basic body 50 is pivotably hinged via an interposed transmission lever 80. The tightening unit 48 comprises an operating element formed as a tightening lever 51 in the embodiment described here. By pivoting the tightening lever 51 clockwise, the basic body 50 is pivotable relative to the neck shell 70 from a position shown in FIG. 5B into a position shown in FIG. 6B.

An axis of the transmission lever 80 connecting the basic body 50 to the neck shell 70 is respectively linked to the neck shell 70 on a first end 82 and to the basic body 50 on a second end 84. The transmission lever 80 is, with an axis, linked to the basic body 50 at a position 62 located on the basic body 50 above a linking point or axis 66 of the tightening lever 51. The tightening lever 51 is, in the area of its linking point 66 on the basic body 50, provided with a cam 52 supported on the transmission lever 80. If the tightening lever 51 is moved clockwise from the position shown in FIG. 5B in which the tightening unit 48 is not tightened into the tightened position shown in FIG. 6B, the cam 52 exerts a pressure on the second end 84 of the transmission lever 80 whereby the lower end of the basic body 50 is, counter-clockwise, pivoted away from the first end 82 of the transmission lever 80 as can be seen in FIG. 6B. The linking points 62 and 64 of the transmission lever which have a distance s1 in the non-tightened position of the tightening unit 48 in FIG. 5B have a substantially greater distance s2 in the tightened position in FIG. 6B. The transmission lever 80 is, on its second end 84, provided with a pre-stressing spring 86 urging the first end 82 of the transmission lever 80 against the lower end of the basic body 50 opposed to the linking point 66 of the tightening lever 51, i.e., into the position shown in FIG. 5B. From this position, the lower end of the basic body 50 is pivoted away from the first end 82 of the transmission lever 80 into the position shown in FIG. 6B if the tightening lever 51 is operated and pivoted from the position shown in FIG. 5B into the position shown in FIG. 6B. The distance s2 shown in FIG. 6B is a consequence only of the effect of the pre-stressing spring 86. The basic body 50 can be pivoted back into the position shown in FIG. 5B without any operation of the tightening lever 51 if tension is exerted on the basic body 50 by the neck band 46. If this tensile stress condition according to FIG. 5B already exists, the basic body 50 is pivoted away from the first end 82 of the transmission lever 80 with its lower end by operating the tightening lever 51 without the distance s1 according to FIG. 5 being changed in the process. If no tension is exerted to the basic body 50 by the neck band 46, the basic body 50 is pivoted by a spring element 88 disposed adjacent to the first end 82 of the transmission lever 80 which strives to pivot the neck shell 70 in the direction away from the first end 82 of the transmission lever 80. In the embodiment illustrated, the spring element 88 is formed as a resilient finger attached to the neck shell 70. Instead, the resilient finger is preferably simply integrally formed on the neck shell 70.

According to the illustration in FIG. 7, the neck shell 70 comprises, at its lower end, a fork 72 having resilient arms 72*a*, 72*b* which engage in complementary bores (not visible) in the first end 82 of the transmission lever 80 with integrally formed tappets (not visible) and, in this way, form the linking point 62 of the transmission lever 80 on the neck shell 70.

According to the illustration in FIGS. 6A and 8, the basic body 50 comprises two surfaces 54, 56 on both sides of the tightening lever 51 which are provided with angular protrusions 54*a* or 56*a* which are in positive engagement with complementary holes 47*a*, 47*b* in the free ends of the neck band 46. The basic body 50 is respectively provided with an orifice 57*a*, 57*b* for accommodating the free ends of the neck band 46 on both sides between the protrusions 54*a*, 56*a* and the tightening lever 51 as can be seen in FIG. 6A.

The particular advantage of the tightening unit 48 according to the invention is that the basic body 50 is pivoted about the second, upper end 84 of the transmission lever 80 which is pivotably supported on the neck shell 70 with its first, lower end 82 when tightening and releasing the same by operating the tightening lever 51 so that the most comfortable position the neck shell 70 occupies on the back of the head after the helmet 30 is put on is not adversely changed. Prior to putting on the helmet 30, the free ends of the neck band 46 are inserted into the orifices 57*a*, 57*b* of the basic body 50, a positive engagement of the holes 47*a*, 47*b* in the neck band 46 and the angular protrusions 54*a*, 56*a* on the basic body is established to crudely adjust the effective length of the supporting band 47 (measured between the inside of the head band 44 and the front side of the neck shell 70) depending on the size of the head when the helmet 30 is not put on. The adjustment is suitably effected so that the protective helmet 30 can be conveniently put on when the tightening unit 48 is not operated. The tightening of the supporting band 47 and thus the neck band 46 after the helmet 30 is put on is then effected with the aid of the tightening unit 48 by operating the tightening lever 51 as described above. The tightening unit 48 is supported by the neck shell 70 in the neck area on the back of the head in the process. The tightened position of the tightening unit 48 is shown in FIG. 6. If the tightening lever 51 is pivoted counter-clockwise and thus opened, the tightening unit 48 is opened. In this way, the lower end of the basic body 50 can move in the direction towards the linking point 62 of the transmission lever 80 on the neck shell 70 so that the neck band 46 and thus the supporting band 47 is untightened, and the protective helmet 30 can be taken off and put on. If the protective helmet 30 is put on, it is only required to pivot the tightening lever 51 downwards to fasten the helmet 30 on the head. This can be conveniently done with one hand and even with a glove. The neck shell 70 is covered by a piece of padding material 89 on the front side.

The invention claimed is:

1. A tightening unit for a supporting band attached to the lower edge of interior fittings of a protective helmet for fastening the helmet on the head of a user comprising a head band continuing in a neck band having two free ends connected by a basic body of the tightening unit comprising an operating element for tightening the supporting band, wherein the tightening unit comprises a neck shell to which the basic body is hinged, and in that the operating element is a tightening lever linked to the basic body by means of which the basic body is pivotable relative to the neck shell, wherein the basic body is pivoted relative to the neck shell by pivoting the tightening lever relative to the basic body.

2. The tightening unit according to claim 1, wherein the basic body and the neck shell are connected by a transmission lever linked to the neck shell_on a first end and to the basic body on a second end.

3. The tightening unit according to claim 2, wherein the transmission lever is linked to the basic body at a position located on the basic body above the linking point of the tightening lever.

4. The tightening unit according to claim 3, wherein the tightening lever is provided with a cam supported on the transmission lever in the area of its linking point on the basic body.

5. The tightening unit according to claim 4, wherein the transmission lever is, on its second end, provided with a pre-stressing spring which urges the first end of the transmission lever against an end of the basic body opposed to the linking point of the tightening lever.

6. The tightening unit according to claim 2, wherein a spring element striving to pivot the neck shell in the direction away from the first end of the transmission lever is disposed adjacent to the first end of the transmission lever.

7. The tightening unit according to claim 6, wherein the spring element is a resilient finger integrally formed on the neck shell.

8. The tightening unit according to claim 2, wherein the neck shell comprises, at the linking point of the transmission lever, a fork having resilient arms which engage in complementary bores in the first end of the transmission lever with integrally formed tappets.

9. The tightening unit according to claim 1, wherein the basic body comprises two surfaces having protrusions on both sides of the tightening lever which protrusions can be brought in a positive engagement with complementary holes in the free ends of the neck band.

10. The tightening unit according to claim 9, wherein the basic body is respectively provided with an orifice for accommodating the free ends of the neck band on both sides between the protrusions and the tightening lever.

* * * * *